United States Patent [19]

Saikatsu et al.

[11] Patent Number: 5,013,966

[45] Date of Patent: May 7, 1991

[54] DISCHARGE LAMP WITH EXTERNAL ELECTRODES

[75] Inventors: Takeo Saikatsu; Takehiko Sakurai; Yoshinori Anzai, all of Kanagawa, Japan

[73] Assignee: Mitsubishi Denki Kabushiki Kaisha, Tokyo, Japan

[21] Appl. No.: 311,350

[22] Filed: Feb. 15, 1989

[30] Foreign Application Priority Data

| | | | |
|---|---|---|---|
| Feb. 17, 1988 | [JP] | Japan | 63-34322 |
| Mar. 10, 1988 | [JP] | Japan | 63-56664 |
| Jun. 6, 1988 | [JP] | Japan | 63-138923 |
| Jun. 6, 1988 | [JP] | Japan | 63-138924 |

[51] Int. Cl.[5] ..... H01J 61/30; H01J 61/42; H01J 61/067

[52] U.S. Cl. ..... 313/493; 313/234; 313/607; 313/634

[58] Field of Search ..... 313/607, 234, 493, 634, 313/248, 488, 485

[56] References Cited

U.S. PATENT DOCUMENTS

| | | | |
|---|---|---|---|
| 702,319 | 6/1902 | Moore | 313/607 X |
| 1,612,387 | 12/1926 | Machlett | 313/607 X |
| 1,676,790 | 7/1928 | Mailey | 313/607 |
| 1,758,516 | 5/1930 | Hendry | 313/607 |
| 2,425,697 | 8/1947 | Hultgren | 313/485 X |
| 2,624,858 | 1/1953 | Greenlee | 313/607 |
| 3,442,582 | 5/1969 | Lahr | 313/488 X |

FOREIGN PATENT DOCUMENTS

| | | |
|---|---|---|
| 3723435 | 1/1988 | Fed. Rep. of Germany . |
| 60-12660 | 1/1985 | Japan . |
| 61-185857 | 8/1986 | Japan . |

OTHER PUBLICATIONS

Patent Abstracts of Japan, E. Field, vol. 11, No. 83, p. 22 E489 (Mar. 13, 1987).

Patent Abstracts of Japan, E. Field, vol. 8, No. 88, p. 145 E 240, (Apr. 21, 1984).

Patent Abstracts of Japan, E. Field, vol. 9, No. 126, p. 1 E 318, (Mar. 31, 1985.

*Primary Examiner*—Palmer C. DeMeo

*Attorney, Agent, or Firm*—Burns, Doane, Swecker & Mathis

[57] ABSTRACT

A discharge lamp comprises a substantially straight glass bulb having a discharge gas charged therein and an electrode provided at each longitudinal end portion of the bulb on the outer surface thereof. A high frequency voltage is applied across the electrodes of the discharge lamp. Each end portion has an outer surface area per unit length of the bulb larger than that at light emitting portion of the bulb. The outer surface area may be uneven or in the shape of ridges and furrows at the end portions to create a large surface area, the electrodes being configured to the ridges and furrows. The end portions may have a larger diameter than that of the light emitting portion of the bulb so that they have a larger surface area contacting with the bulb. Each of the electrodes may have a narrow belt-shaped elongate portion on the outer surface of the bulb extending longitudinally within toward the middle portion, thereby allowing use of a lower discharge voltage. The fluophor may be applied to the inner surface area except the surface opposite the electrodes.

3 Claims, 7 Drawing Sheets

DISCHARGE LAMP WITH EXTERNAL ELECTRODES

BACKGROUND OF THE INVENTION

1. Field of the Invention

The present invention relates to a discharge lamp in which a pair of electrodes are provided on the outer surface of a substantially straight glass bulb. Fluophor is applied to the inner surface of the bulb, and a discharge gas such as a rare gas or a rare gas plus metal vapor is charged therewithin.

2. Prior Art

FIG. 2 is a partially cutaway view a fluorescent lamp of an aperture type, disclosed in Japanese Patent KOKAI publication No. 61-185857. The straight glass bulb 1 contains an inert gas and metal vapor such as mercury. The inner wall of the glass bulb 1 is provided with a reflecting film 4 except at an opening 2, and a fluophor 3 is provided on the reflecting film 4. A pair of metal electrodes 5,6 are provided on the outer circumferential surface of the bulb in the proximity of both ends of the bulb. A high frequency generator circuit 7, connected to an ac power source 8, applies a high frequency voltage across the pair of electrodes 5,6. The applied voltage causes a high frequency electromagnetic field to be developed across the electrodes 5,6. This field excites the metal vapor in the glass bulb 1 to emit ultraviolet rays, which in turn cause visible light to be emitted with the aid of fluophor applied on the inner wall of the bulb 1.

A discharge lamp is of simple construction and easy to manufacture. Also the discharge lamp has a long life since it has no filaments therein and is free from the problem where portions near the electrodes become black over time.

The discharge lamp provides more light as the area of electrodes 5 and 6 which contacts with the outer circumferential surface of the glass bulb is increased. However, since the electrodes enclose the glass bulb 1 in the vicinity of both ends thereof, the amount of light emitted is decreased, thereby reducing the effective length in the longitudinal direction of the glass bulb 1. Extending the electrodes in the longitudinal direction increases the area of the electrodes providing more light. On the other hand, extending the electrodes causes a shorter effective length of the bulb 1 that contributes to light emission. The discharge lamps, in which a high frequency is applied across both end portions thereof to cause the discharge, develops a positive column at the middle portion of the bulb. The positive column is highly efficient and uniform in light intensity but the long distance between the electrodes requires a high voltage for initiating discharge.

FIG. 9 is a longitudinal cross-sectional view of a fluorescent lamp disclosed in Japanese Patent KOKAI publication No. 60-12660 and FIG. 10 is an enlarged transverse cross-sectional view thereof. In the figures, the glass bulb 1 is charged with mercury vapor and a rare gas 2 therein and has fluophor 3 applied on the entire inner wall thereof. A pair of electrodes 5 and 6 are disposed on the outer circumferential surface of the glass bulb 1. The high frequency generating circuit 7, connected to a power source by a switch 17 and a plug 13, applies a high frequency voltage across the electrodes 5,6. The applied high frequency voltage causes a discharge 16 in the bulb 1. This discharge excites the mercury atoms to thereby develop ultraviolet rays which in turn cause the fluophor to emit visible light. Such a type of fluorescent lamp suffers from the problem that strong impact by electrons and ions causes deterioration of the fluophor at the portions **4*a*, 4*b* on the inner surface of the bulb opposite to the electrodes 5,6**, causing the amount of light to decrease with time. Therefore the life-time of the discharge lamp will be shorter in optical information apparatuses, particularly a facsimile apparatus where a change in light output with time can be a problem.

SUMMARY OF THE INVENTION

An object of the present invention is to provide a discharge lamp in which the area of the electrodes contacting with the circumferential surface of the discharge bulb can be made larger without extending the electrode mounted on both end portions of a straight glass bulb in the longitudinal direction thereof, thereby obtaining a long effective length of the glass bulb. A surface, and particularly ridges and furrows formed on the end portions of the glass bulb cause increased surface area of the bulb contacting with the electrodes at that portion. The electrodes are configured to the ridges and furrows **10*a* and 11*a***.

Another object of the invention is to provide a discharge lamp in which the circumferential length of the straight glass bulb is made larger than that of the light emitting portion thereof, thereby obtaining a long effective length of the glass bulb.

Still another object of the invention is to provide discharge lamp of simple construction, having a low discharge-initiating voltage, but not being impaired by emitted light therefrom.

Yet another object of the invention is to provide a long-life fluorescent lamp without a significant change in the amount of light emitted with time.

BRIEF DESCRIPTION OF THE DRAWINGS

Further features and details of the present invention will be apparent from the following description of specific embodiments which are given by way of example with reference to the accompanying drawings, in which.

DETAILED DESCRIPTION OF THE PREFERRED EMBODIMENTS

Figure 1A:
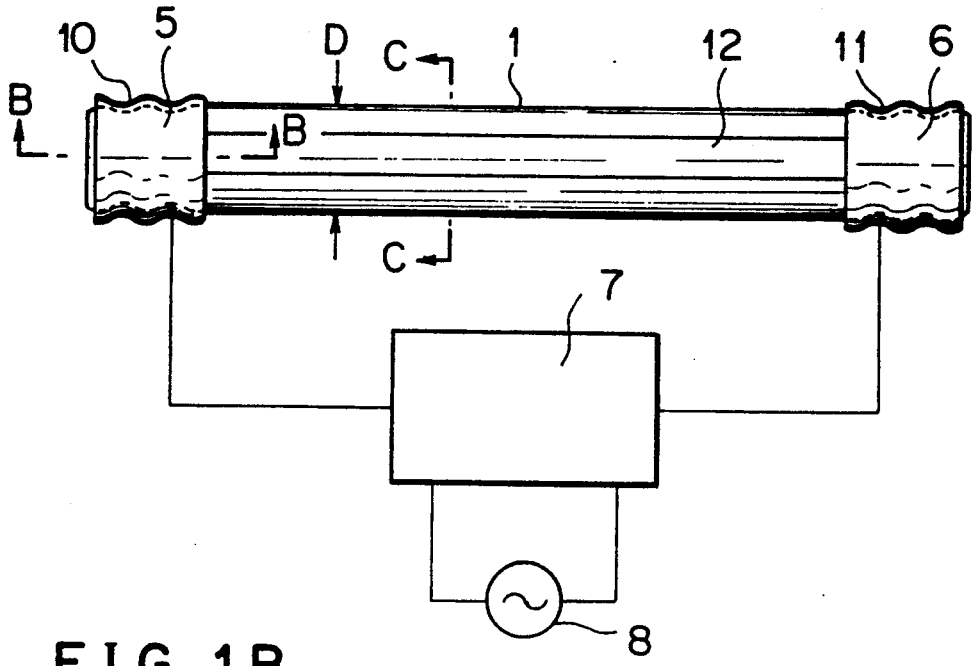
FIG. 1A is a diagram showing a first embodiment of the present invention.
Figure 1B:
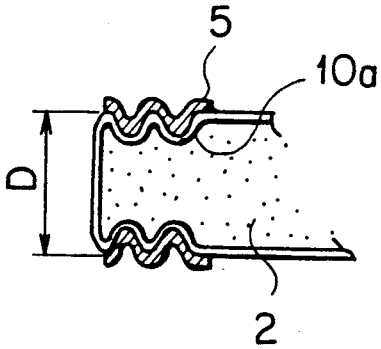
FIG. 1B is a cross-sectional view taken along the line B—B in FIG. 1A.
Figure 1C:
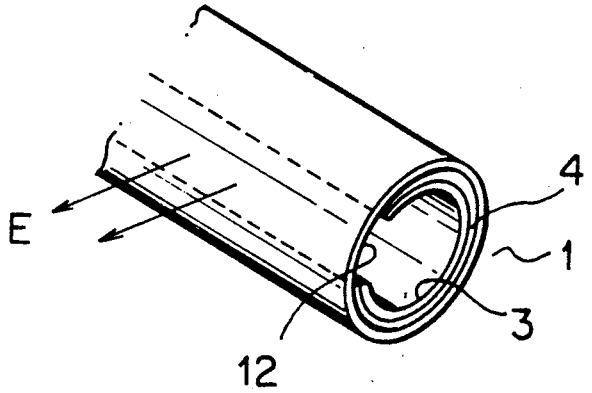
FIG. 1C is a cross-sectional view taken along the line C—C in FIG. 1A.

FIG. 1A illustrates a first embodiment of the invention. FIG. 1B and FIG. 1C illustrate a cross-section taken along the line B—B in FIG. 1A and a cross section taken along the line C—C, respectively. Conductors or electrodes 5,6 are disposed on the outer circumferential surface of a substantially straight glass bulb 1 in the proximity of both ends thereof. The glass bulb 1 contains mercury vapor and a rare gas 2 therein. A reflecting film 4 is provided on the inner wall of the bulb 1, except for a portion 12, forming an aperture through which visible light is emitted. The fluophor 3 is applied over the reflecting film. As shown in FIG. 1B, the glass bulb 1 is provided with circumferential recesses at the end portions 10,11 thereof to form an uneven surface or a plurality of ridges and furrows 10*a*, 11*a* on which the electrodes 5,6 are configured to these ridges and furrows 10*a*, 11*a*. A high frequency generator circuit 7, powered by an ac power source 8, applies a high frequency voltage across the electrodes 5,6 so that a light is emitted through a portion 12 in the direction illustrated by arrow E shown in FIG. 1C.

Figure 2:
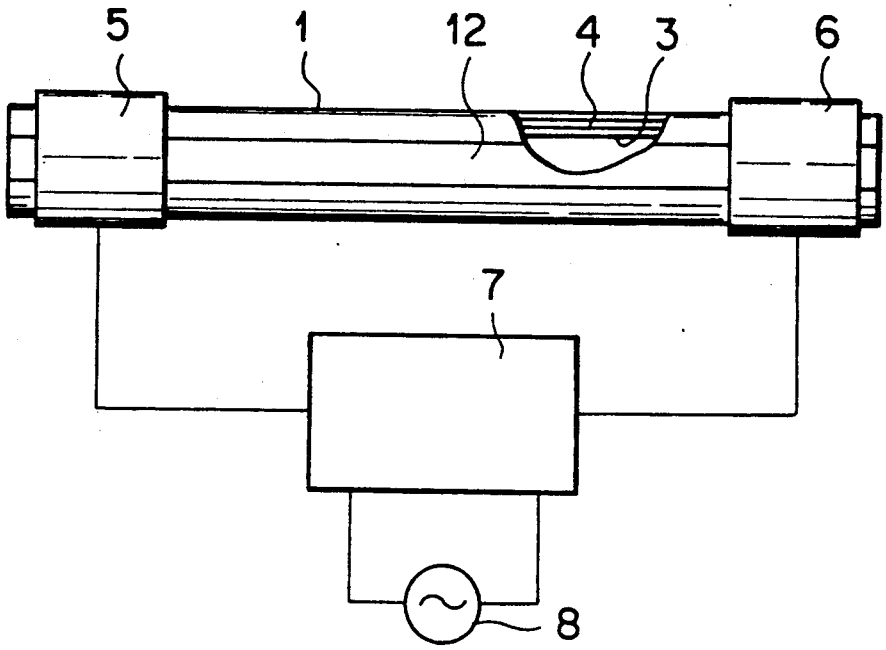
FIG. 2 PRIOR ART
FIG. 2 is a diagram illustrating a general arrangement of a first prior art fluorescent lamp.

An inert gas, such as argon gas or an inert gas plus a metal vapor, within the glass bulb 1 is charged. The inner surface of the bulb 1 is provided with a reflecting film (not shown) except for the aperture portion similar to that shown in FIG. 2. The high frequency generating circuit 7 becomes operative when the power is turned on as in the prior art. The circuit 7 applies a high frequency voltage across the electrodes 5,6 for ionizing the metal vapor in the glass bulb 1 to initiate discharge between the electrodes. The metal vapor charged in the glass bulb 1 is excited to emit ultraviolet rays, which in turn cause the fluophor 3 applied on the reflecting film to emit visible light. The visible light is emitted outside the bulb 1 directly through the aperture 12 of the glass bulb 1 or after being reflected by the reflecting film. The amount of light emitted depends on the area of the electrode 5,6 contacting with the bulb. The ridges and furrows 10*a*, 11*a* formed on the end portions of the bulb provide a larger area of the electrodes 5,6 which contacts with the bulb per axial length as compared to the prior art lamp where electrodes are provided on the cylindrical end portion of the same diameter as the rest of the bulb. Here, "axial length" means length as measured along a straight axis parallel to the length of the bulb. Thus this embodiment provides a longer effective length of the glass bulb 1 with the dimension of the electrodes in the longitudinal direction of the bulb 1 being unchanged.

Although the recesses are provided in the vicinity of the both ends of the glass bulb 1 to form ridges and furrows 10*a*, 11*a* thereon, protrusions may also be provided to obtain the same effect.

Figure 3:
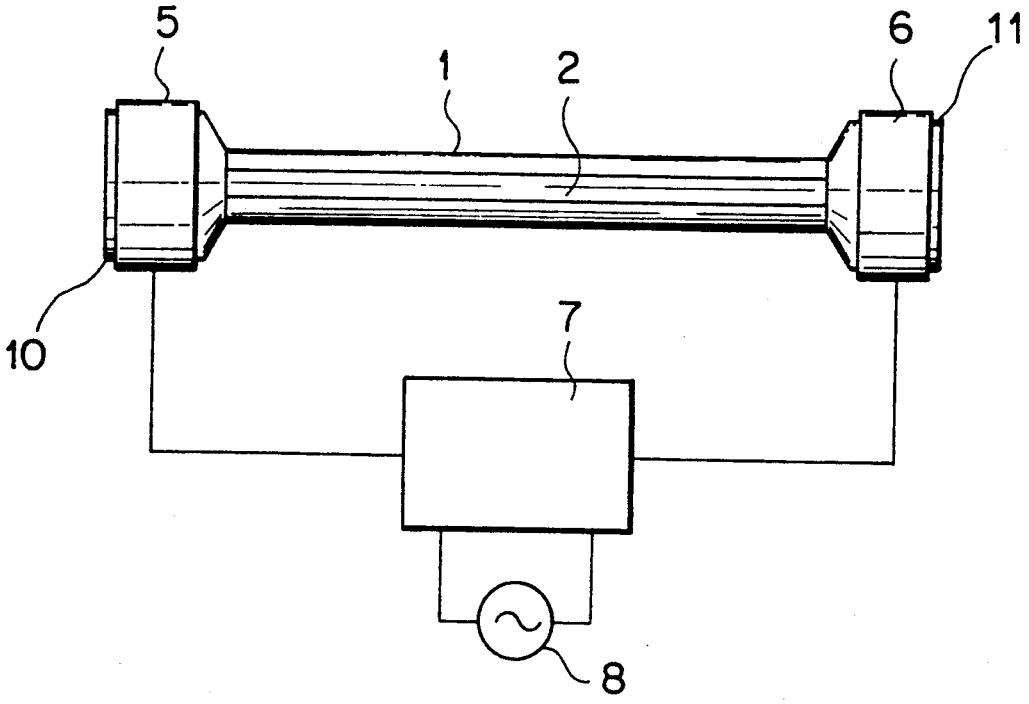
FIG. 3 is a diagram showing a second embodiment of the invention.

FIG. 3 shows a second embodiment of the invention. The diameter of the bulb 1 to which the electrodes 5,6 are disposed is greater than that of light emitting portion. This arrangement can also provides a larger area of the electrodes contacting with the bulb 1 per axial length than a bulb having the same diameter over the entire length thereof, thereby providing a longer effective length of the discharge bulb with the dimension of the electrodes in longitudinal direction of the bulb being unchanged.

Figure 4A:
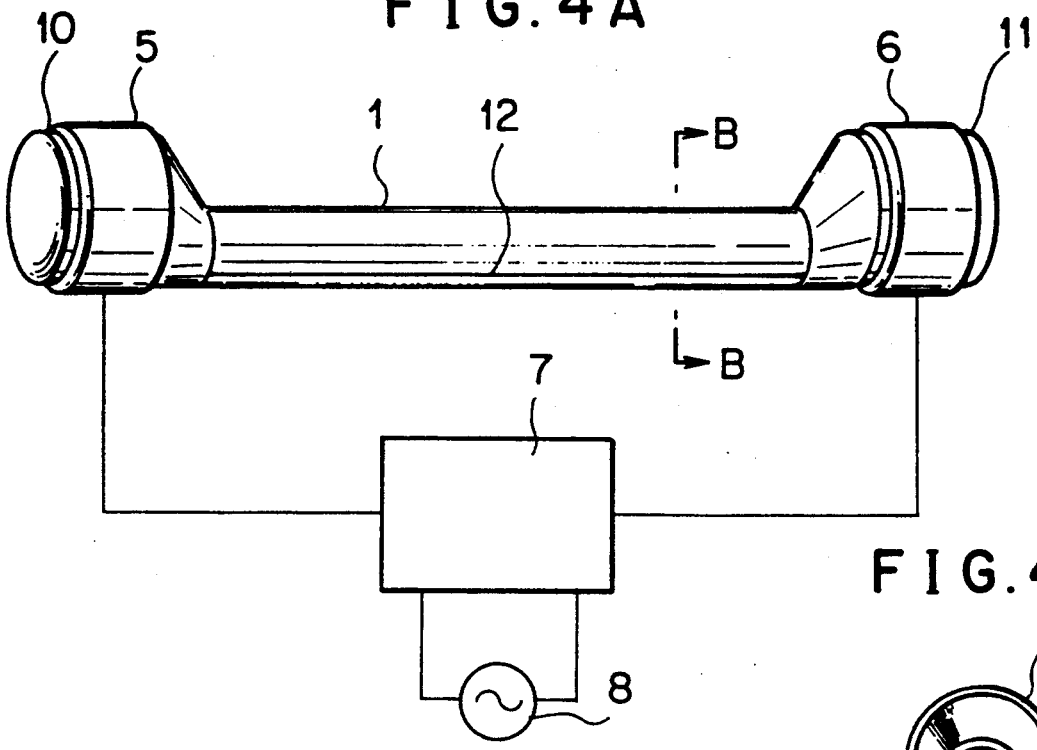
FIG. 4A is a diagram showing a third embodiment of the invention.
Figure 4B:
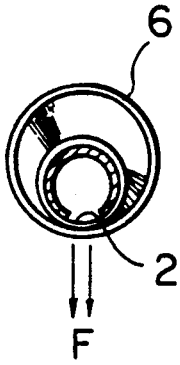
FIG. 4B is a cross-sectional view taken along the line B—B of FIG. 4A.

FIG. 4A shows a third embodiment of the invention. As is apparent from FIG. 4A, the end portions 10,11 on which electrodes 5,6 are provided are not coaxial with the portion where light is emitted, so that the surface of the electrodes will be substantially flush with the aperture 12 through which the light is transmitted outwardly. FIG. 4B is a cross-sectional view taken along the line B—B of FIG. 4A, wherein the arrows F indicate the light transmitted through the aperture 2. This arrangement is particularly useful when the light emitting portion must be positioned very close to an object that requires illumination. The end portions 10,11 may have a cross section of a rectangular or other non-circular shape. The electrodes enclose only the circumferential surface of the end portions of the bulb but, may also enclose the end surface thereof.

Figure 5A:
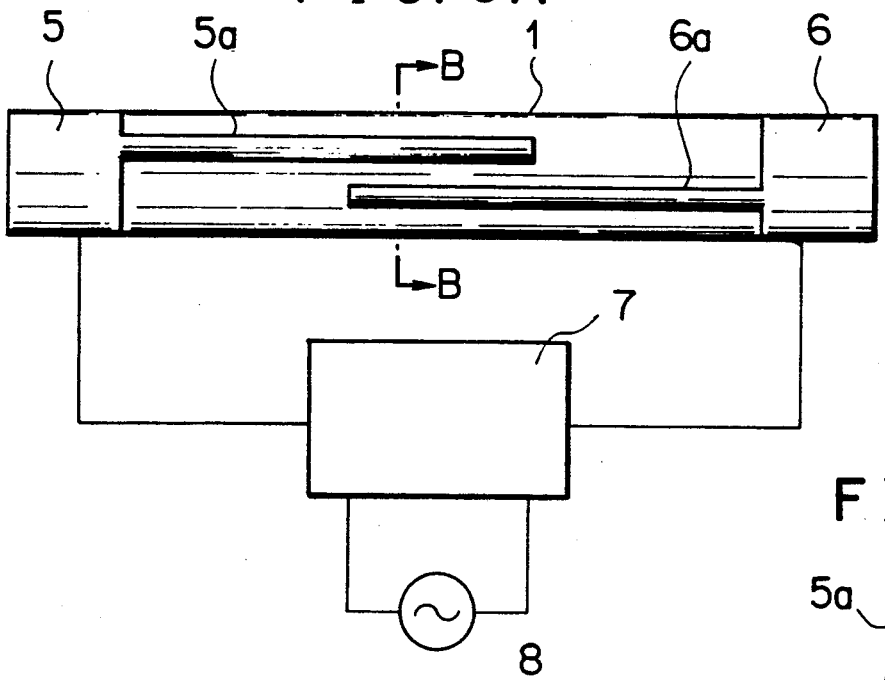
FIG. 5A is a diagram showing a fourth embodiment of the invention.
Figure 5B:
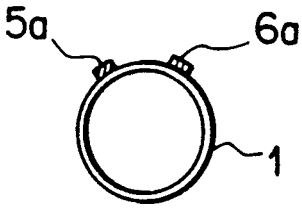
FIG. 5B is a cross-sectional view taken along the line B—B of FIG. 5A.

FIG. 5A shows a fourth embodiment of the invention and FIG. 5B is a cross-sectional view taken along the line B—B of FIG. 5A.

The electrodes 5,6 enclose the entire circumferential surface at the end portion of the glass bulb 1 and a a narrow belt-shaped portion 5*a*, 6*a* which extends longitudinally toward the center of the bulb 1. The short distance between the electrodes 5,6 at a middle portion of the bulb 1 causes a high electric field in the bulb, thus allowing the discharge to take place easily at a low voltage. The width of the electrodes 5*a*, 6*a* at the middle portion of the bulb 1 is narrow and the area thereof is small; therefore a discharge current due to the portions 5*a*, 6*a* is small which in turn causes only a small amount of light to be emitted. Thus the discharge lamp can provide substantially uniform distribution of light emission across the entire length thereof, which is equivalent to that having the electrodes only at both end portions. This effect can be derived from the shape of the electrodes 5,6. This shape is simple to manufacture.

Figure 6A:
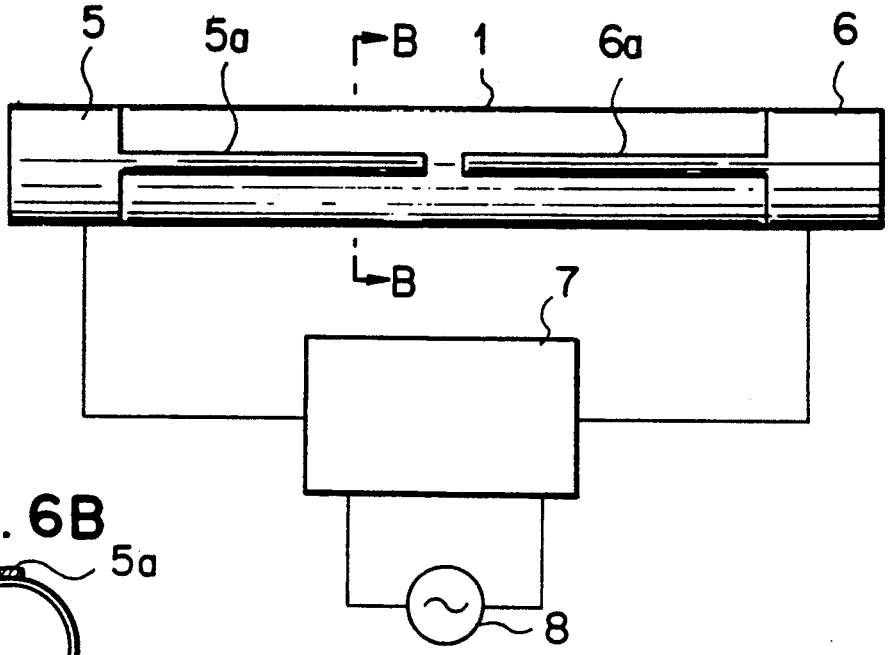
FIG. 6A is a diagram illustrating a fifth embodiment of the invention.
Figure 6B:
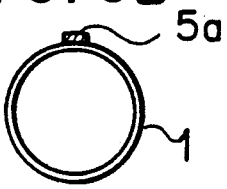
FIG. 6B is a cross-sectional view taken along the line B—B of FIG. 6A.

FIG. 6A illustrates a fifth embodiment of the invention and FIG. 6B shows a cross-sectional view taken along the line B—B of FIG. 6A. In this embodiment, the narrow belt-shaped portions 5*a*, 6*a* of the electrodes 5,6 are disposed parallel to each other in the vicinity of the middle portion of the glass bulb 1. In this manner, varying the lengths of the parallel portions also allows a decrease in discharge-initiating voltage.

Figure 7B:
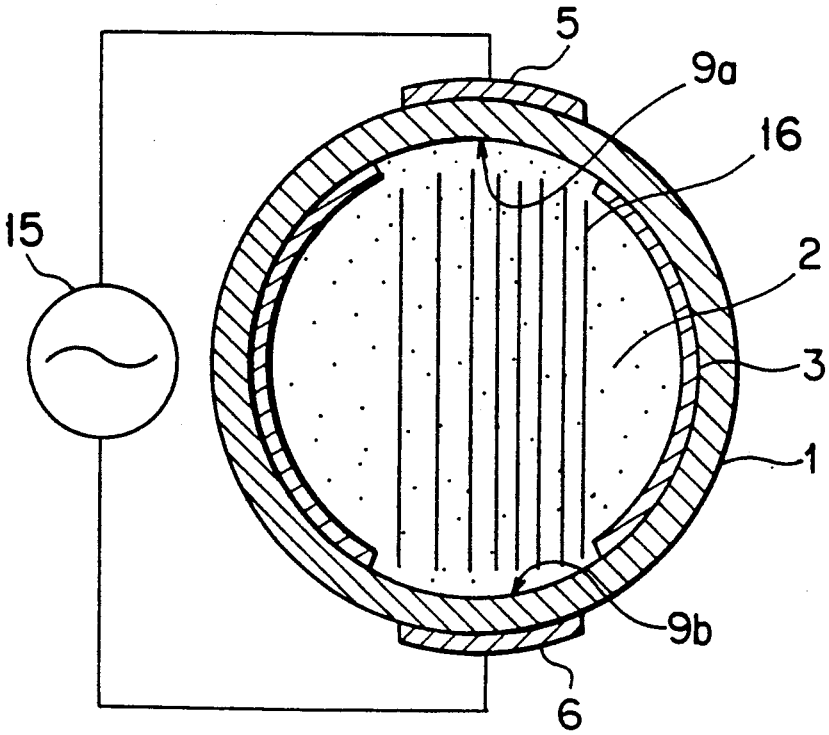
FIG. 7B is a cross-sectional view taken along the line B—B of FIG. 7A.
Figure 7A:
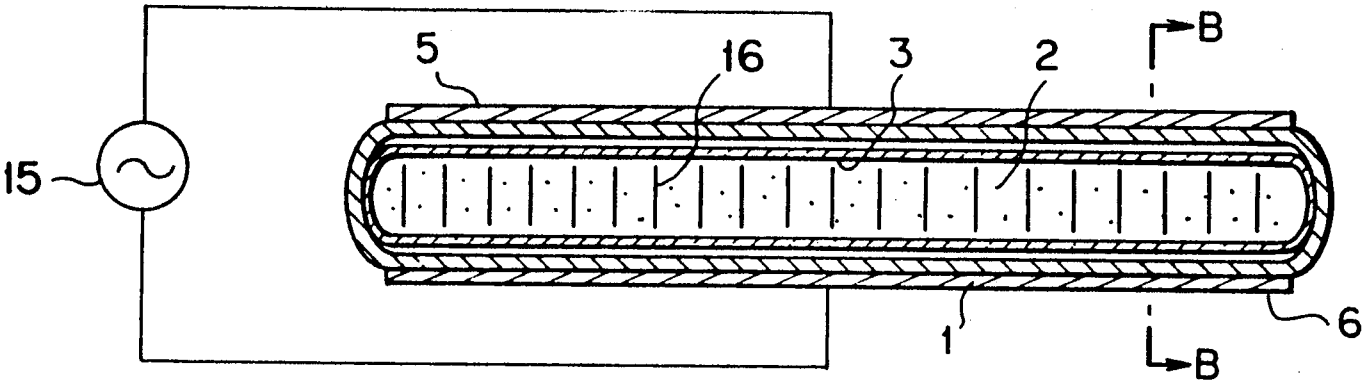
FIG. 7A is a diagram showing a sixth embodiment of the invention.
Figure 9:
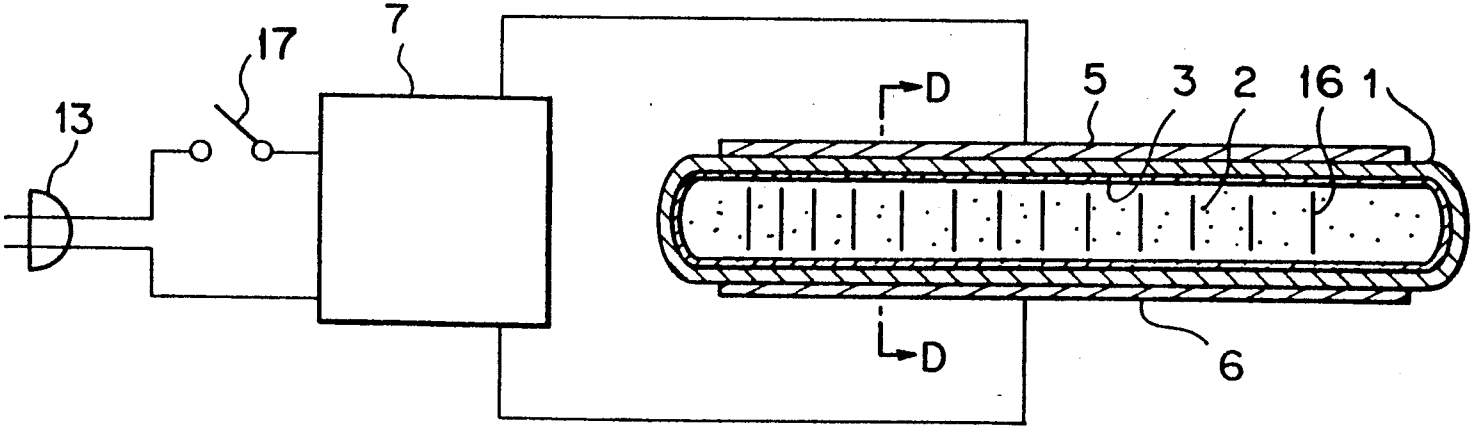
FIG. 9 PRIOR ART
FIG. 9 is a longitudinal cross-sectional view of a second prior art fluorescent lamp.

FIG. 7A shows a sixth embodiment of the invention and FIG. 7B illustrates a cross-section taken along the line B—B of FIG. 7A. When the high frequency voltage is applied across the electrodes, the discharge 16 takes place as shown. A high potential difference is developed at across the inner surface of a discharge glass bulb opposite to electrodes mounted on the outer circumferential surface thereof. The electrons and ions, accelerated by this voltage, impinge the inner wall of the glass bulb, causing damage to the fluophor applied.

In this embodiment, the fluophor 3 applied on the inner surface of the bulb has apertures 9*a*, 9*b*, diametically opposite to each other as shown in FIG. 7B and extending longitudinally of the glass bulb. On the outer surface of the bulb 1 are provided electrodes 5,6 at locations opposite to the apertures 9*a*, 9*b*, where the fluophor does not exist. The electrodes 5,6 also extend longitudinally within the glass bulb. By this arrangement, rapid deterioration of the fluophor 3 due to impact of the electrons and ions is prevented. Additionally, forming the electrodes 5,6 from a high reflection material provides more reflection from the apertures 9*a*, 9*b*, thus allowing effective use of light emitted.

Figure 8A:
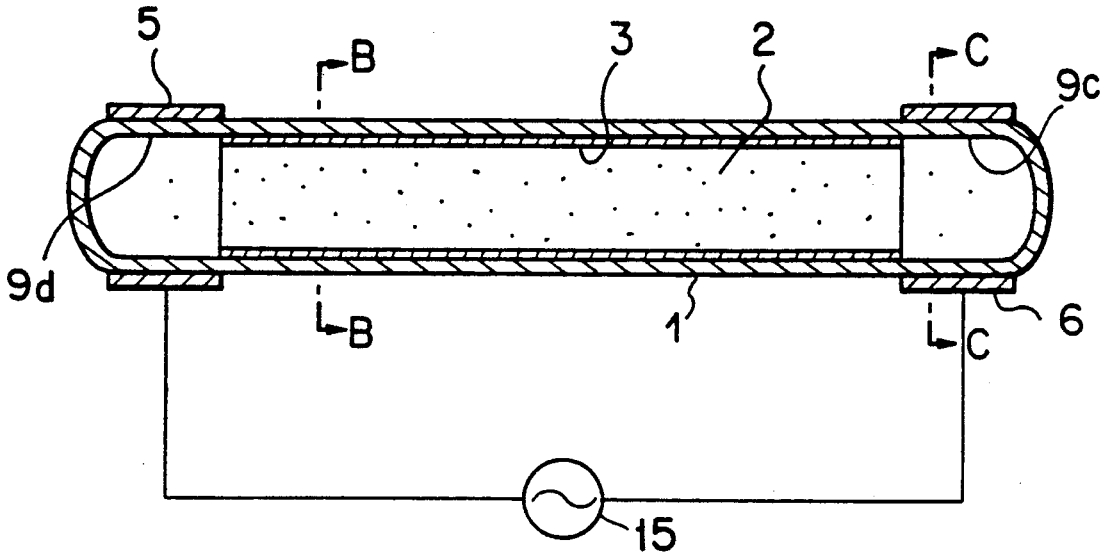
FIG. 8A is a longitudinal cross-sectional view of a seventh embodiment of the invention.
Figure 8B:
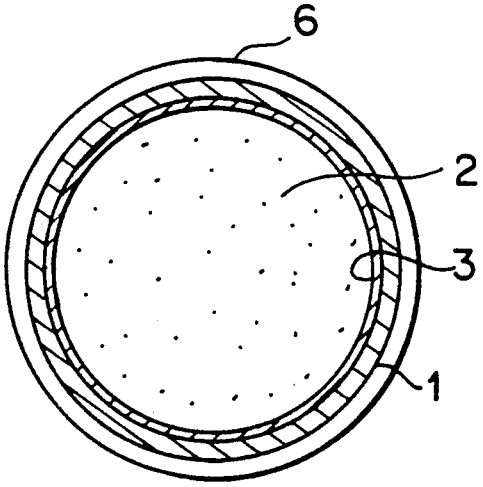
FIG. 8B is a cross-sectional view taken along the line B—B of FIG. 8A.
Figure 8C:
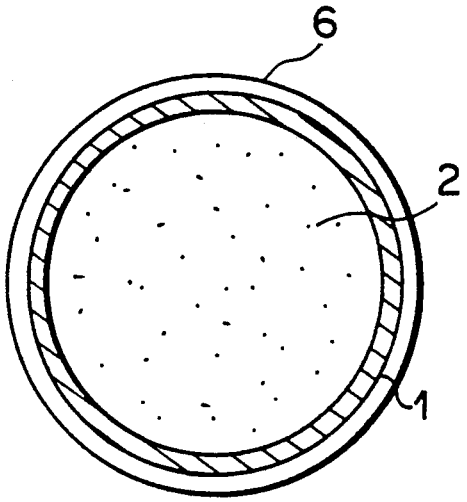
FIG. 8C is a cross-sectional view taken along the line C—C of FIG. 8A.
Figure 10:
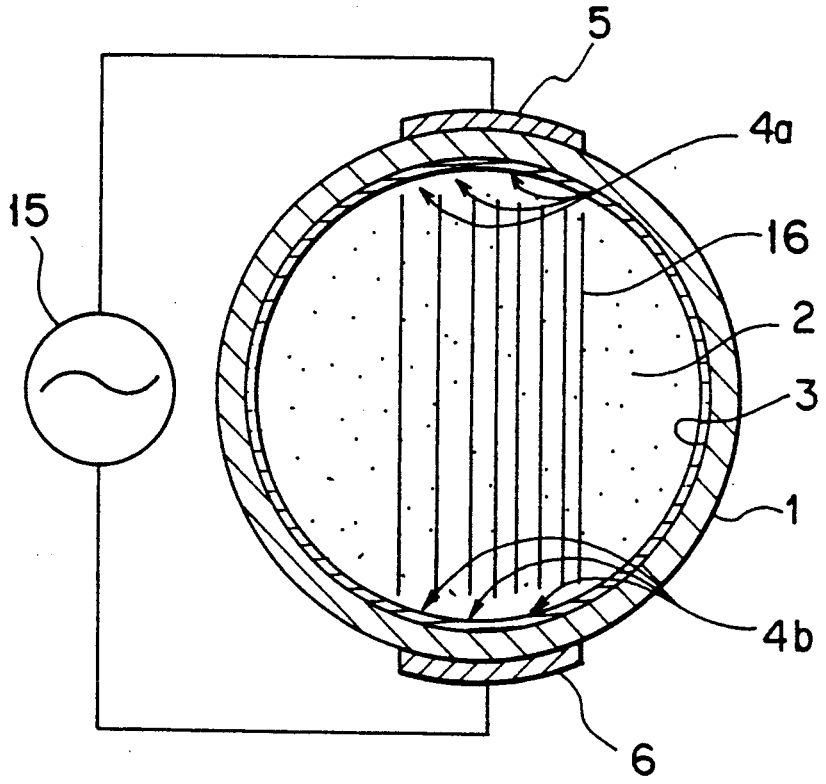
FIG. 10 PRIOR ART
FIG. 10 is an enlarged transverse cross-sectional view of taken along the line D—D of the second prior art fluorescent lamp in FIG. 9.

FIG. 8A is a vertical cross-sectional view of an eighth embodiment of the invention. The fluophor 3 is applied to the inner surface of the glass bulb 1 except both end portions of the bulb 1 where electrodes 5,6 are provided. FIG. 8B shows a cross-sectional view taken along the line B—B of FIG. 8A and FIG. 8C illustrates a cross-sectional view taken along the line C—C. The high frequency generating circuit 15 applies the high frequency voltage across the electrodes 5,6, thereby initiating the discharge between the electrodes. Since the fluophor does not exist at the inner surface of the bulb opposite to the electrodes, a high potential difference is developed at the inner surface of a discharge glass bulb opposite to electrodes mounted on the outer circumferential area, will not cause rapid deterioration of the fluophor 3 due to impact of the electrons and ions.

What is claimed is:

1. A discharge lamp comprising a substantially straight glass bulb having a discharge gas charged therein and an electrode provided at each longitudinal end portion of said bulb on an outer surface thereof, and a light emitting portion of said bulb located between said electrodes, said discharge lamp having a high frequency voltage applied across said electrodes, said each end portion having an outer surface which forms ridges and furrows, said electrodes being conformed to said ridges and furrows.

2. A discharge lamp comprising a substantially straight glass bulb having a discharge gas charged therein and an electrode provided at each longitudinal end portion of said bulb on an outer surface thereof, said discharge lamp having a high frequency voltage applied across said electrodes, wherein each of said electrodes has a belt-shaped elongate portion on the outer surface of said bulb extending longitudinally toward a middle portion of said bulb, each of said belt-shaped elongate portions extending beyond the middle portion of said bulb and in parallel with each other.

3. A discharge lamp comprising a substantially straight glass bulb having a discharge gas charged therein and electrodes mounted on an outer surface thereof, said electrodes being disposed longitudinally along the bulb and opposite to each other with said bulb therebetween and said discharge lamp having a high frequency voltage applied across said electrodes, wherein a fluophor is applied to an inner surface of said glass bulb except to portions of said inner surface opposite said electrodes.

* * * * *